United States Patent [19]

Beyer et al.

[11] Patent Number: 4,480,563

[45] Date of Patent: Nov. 6, 1984

[54] TUFTING NEEDLE

[75] Inventors: Walter Beyer, Eschweiler; Joachim Beyer, Aachen, both of Fed. Rep. of Germany

[73] Assignee: Jos. Zimmermann, Aachen, Fed. Rep. of Germany

[21] Appl. No.: 400,367

[22] Filed: Jul. 21, 1982

[30] Foreign Application Priority Data

Jul. 25, 1981 [DE] Fed. Rep. of Germany ... 8121878[U]

[51] Int. Cl.[3] ..... D05C 15/00

[52] U.S. Cl. ..... 112/222; 112/79 R

[58] Field of Search ..... 112/222, 79 R; 28/115; 223/102

[56] References Cited

U.S. PATENT DOCUMENTS

| | | | |
|---|---|---|---|
| 3,618,542 | 11/1971 | Zochen | 112/222 |
| 3,812,799 | 5/1974 | Spanel et al. | 112/79 R |
| 3,862,611 | 1/1975 | Kuromegawa | 112/222 |
| 4,194,457 | 3/1980 | Parson | 112/222 |
| 4,195,584 | 4/1980 | Falk et al. | 112/222 |

*Primary Examiner*—Ronald Feldbaum

*Attorney, Agent, or Firm*—Lalos, Leeds, Keegan, Lett, Marsh, Bentzen & Kaye

[57] ABSTRACT

In a tufting needle for tufting machines comprising an operative shank portion of oblong cross-section and containing a thread guide and eye and an anchoring shank portion by which the needle is embedded in a needle module, said anchoring portion is of elliptical or rhombic cross-section and the major axes of the cross-sections of both portions are disposed in substantially the same plane.

6 Claims, 10 Drawing Figures

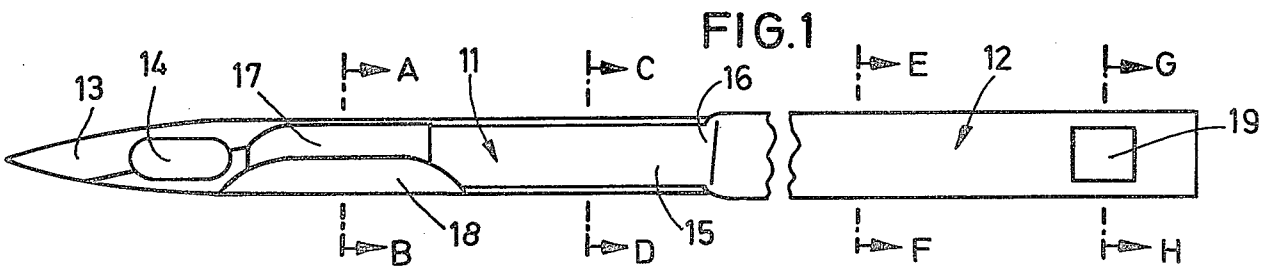
FIG.1
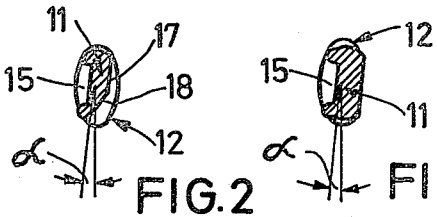
FIG.2
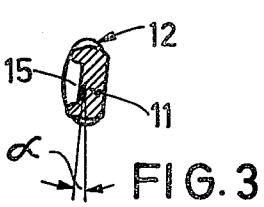
FIG.3
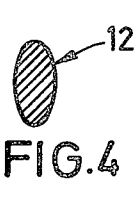
FIG.4
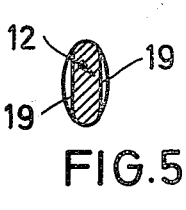
FIG.5
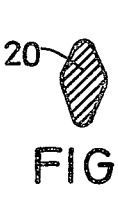
FIG.6
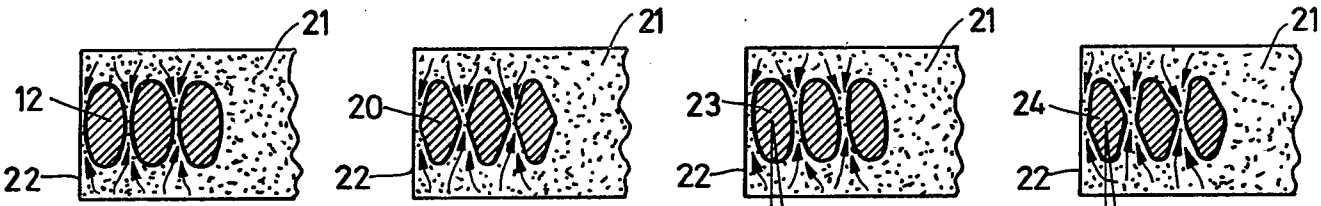
FIG.7
FIG.8
FIG.9
FIG.10

TUFTING NEEDLE

DESCRIPTION OF THE PRIOR ART

The invention relates to a tufting needle for needle modules of tufting machines, wherein the free shank portion has a flat cross-section and is provided with a thread groove and an eye.

For the production of needle modules of tufting machines, tufting needles of the aforementioned kind are employed in which the shank portion, also termed stock, to be moulded in the module body is of circular cross-section. Tufting needles of this construction meet requirements when used for modules having a comparatively wide needle distribution in which the needles are arranged at correspondingly large spacings in the module body. However, tufting needles of such construction present difficulties for making needle modules with a dense needle distribution because the needle pitch is limited by the diameter of the shank portion to be embedded and because moulding them into the module body leaves much to be desired if the spaces between the shank portions to be embedded are very small.

To remedy this, a tufting needle for making needle modules for tufting machines has already been proposed (DE-OS 28 28 246) wherein not only the free shank portion but also the portion to be embedded or the anchoring shank portion has a flat cross-section. By reason of the flat construction of the portion to be embedded, it is possible to arrange tufting needles of this kind at close spacings on the needle module. Apart from this, the flat construction of the shank portion of the known tufting needle to be embedded gives security against rotation thereof in the needle module. However, the flat construction of the shank portion of the known tufting needle that is to be embedded is not an optimum for moulding it into the module body and for anchoring it therein.

DESCRIPTION OF THE INVENTION

The invention aims to provide a tufting needle for needle modules of tufting machines, which has the advantages of the known needle with a flat shank portion to be embedded but in addition is particularly suitable for moulding into the module body and for being securely anchored therein.

The tufting needle according to the present invention is characterised particularly in that the shank portion thereof to be embedded is of elliptical or rhombic cross-section, with the major axes of the cross-sections of the free shank portion and of the portion to be embedded being disposed in the same or nearly the same plane.

By reason of the construction of the new tufting needle in accordance with the invention, it is likewise possible to arrange it in the needle module at a close pitch, especially if, as is preferred, the cross-section of the shank portion to be embedded is considerably larger along its major than its minor axis. In addition, because of its construction, the new tufting needle is particularly suitable for moulding into the module body because, during the moulding in operation when the shank portion to be embedded has an alloying material cast about it, the alloying material can flow without hindrance from the narrow longitudinal edges of the shank portion to be embedded between the adjacent side faces thereof. Further, the construction of the new needle facilitates secure anchorage in the module body because, after being moulded therein, the embedded portion is intimately surrounded by the material of the module body without any defective locations.

The cross-sectional shape of the shank portion to be embedded likewise secures the new tufting needle in the module body against rotation. As a safeguard against axial displacement of the new needle in the module body, the invention provides for the shank portion to be embedded to have a flat in known manner at a spacing from its front and rear ends at least at one side. When moulding the needle into the module body, this flat is filled with alloying material which then prevents longitudinal displacement of the needle in the module body.

After installing needle modules made with the new needles in a tufting machine, to ensure that the new needle will assume the correct position in relation to the associated gripper of the machine, it can be moulded into the module body with an appropriate twist of a few degrees about its longitudinal axis. On the other hand, the invention can provide for the free shank portion of the new needle to be twisted a few degrees in known manner relatively to the shank portion to be embedded.

Examples of the new tufting needle and needle modules made therewith for tufting machines are illustrated in the partly diagrammatic drawing, wherein FIG. 1 is a side elevation of one embodiment of tufting needle;

FIG. 2 shows the free shank portion of the tufting needle in a section on line A–B in FIG. 1;

FIG. 3 shows the free shank portion of the tufting needle in a section on line C–D in FIG. 1;

FIG. 4 shows the shank portion of the tufting needle that is to be moulded in in a section on line E–F in FIG. 1;

FIG. 5 shows the shank portion to be embedded in a section on line G–H in FIG. 1;

FIG. 6 is a cross-section of the shank portion to be embedded of a different embodiment of tufting needle;

FIG. 7 is a fragmentary cross-section of one embodiment of a needle module made from tufting needles of elliptical section at the shank portion to be embedded;

FIG. 8 is a fragmentary cross-section of an embodiment of a needle module made from tufting needles of rhombic cross-section at the shank portion to be embedded;

FIG. 9 is a fragmentary cross-section of a further embodiment of a needle module made from tufting needles of elliptical section at the shank portion to be embedded; and FIG. 10 is a fragmentary cross-section of a further embodiment of a needle module made from tufting needles of rhombic cross-section at the shank portion to be embedded.

The tufting needle shown in FIGS. 1 to 5 has a free shank portion 11 and a shank portion 12 that is to be embedded.

The free shank portion 11 has a flat rectangular cross-section. The point of the needle is formed at 13 by the front end of the free shank portion. Adjoining the needle point, the free shank portion is provided with the eye 14. This is followed at one side face of the free shank portion by a thread guide channel 15 which extends substantially up to the junction 16 between the free shank portion and the portion to be embedded. At its opposite side face, the free shank portion is provided adjacent to the eye 14 with a hollow fillet 17 and a chamfer 18 for the passage of a gripper co-operating with the needle.

The shank portion 12 to be embedded has an elliptical cross-section. Its major axis is considerably longer than its minor axis, namely in the ratio of about 2:1. At a spacing from its front and rear ends, the shank portion to be embedded is provided at both opposed side faces with a respective flat 19.

As shown in FIGS. 2 and 3, in the illustrated tufting needle the free shank portion 11 is twisted by an angle $\alpha$ to the shank portion to be embedded, namely by appropriately twisting the needle at the junction 16 between the two shank portions. The twist amounts to about 6°.

The tufting needle of which the shank portion 20 to be embedded is shown in cross-section in FIG. 6 has a construction as shown in FIGS. 1 to 5 except that the cross-section of the shank portion to be embedded is rhombic instead of elliptical. Again, this cross-section is considerably longer along the major than the minor axis, the proportion of dimensions again being about 2:1.

The needle module shown in FIG. 7 is made from tufting needles of the FIGS. 1 to 5 construction. In this module, the shank portion 12 of the tufting needles is so embedded in the module body 21 that the major axis is accurately parallel to the end faces 22 of the module body. The small arrows shown in the module body 21 indicate how the alloy material of which the module body is formed and by which the needles are moulded in tends to flow between the side faces of the shank portion 12 from the narrow longitudinal edges thereof.

The needle module of FIG. 8 is made from tufting needles having the FIG. 6 cross-section of the shank portion 20 to be embedded. In other respects, this module corresponds to that in FIG. 7.

The needle module of FIG. 9 is made with needles of which the shank portion 23 to be embedded is likewise elliptical in cross-section but without any twist between the two shank portions. Since there is no such twist, their shank portion to be embedded is so moulded into the module body 21 that their major axis is in each case at an angle $\beta$ to a line parallel to the end faces 22 of the module body 21. The angle $\beta$ is about 6°.

The needle module of FIG. 10 corresponds to that of FIG. 9 except that it is made with tufting needles of rhombic cross-section at their shank portions 24 to be embedded.

The small arrows included in FIGS. 8 to 10 are likewise intended to indicate how, during moulding of the needles into the module body, the allow material from which the latter is formed flows between the longitudinal faces of the shank portions to be embedded from the narrow longitudinal edges thereof.

In so far as the shank portions to be embedded are of rhombic cross-section, the latter is, as shown in FIGS. 6, 8 and 10, rounded off at the narrow longitudinal edges as well as the central part of its side faces, which likewise contributes to good moulding-in in the module body.

We claim:

1. A tufting needle for needle modules of tufting machines having a free shank portion with a flat cross section provided with a thread groove and eye and an anchoring shank portion, the improvement comprising:

said anchoring shank portion being of an elliptical cross section having major and minor axes wherein the major axis is of greater length than the minor axis, the major axis of the cross sections of said free and anchored shank portions being substantially co-planar.

2. A tufting needle for needle modules of tufting machines having a free shank portion with a flat cross section provided with a thread groove and an eye and having an anchored shank portion, the improvement comprising:

said anchored shank portion being of rhombic cross section having a major and minor axis wherein the major axis is a greater length than the minor axis, the major axis of said free and anchored shank portions being substantially co-planar.

3. A tufting needle according to claim 1 wherein said anchored shank portion has a flat segment spaced from its front and rear ends on at least one side thereof.

4. A tufting needle according to claim 1 wherein said free shank portion is twisted relative to said anchored shank portion.

5. A tufting needle according to claim 2 wherein said anchored shank portion has a flat portion spaced from its front and rear ends on at least one side thereof.

6. A tufting needle according to claim 2 wherein such free shank portion is twisted relative to said anchored shank portion.

* * * * *